US006834931B2

(12) United States Patent
Ang et al.

(10) Patent No.: US 6,834,931 B2
(45) Date of Patent: Dec. 28, 2004

(54) SPITTOON SYSTEM FOR WASTE INKJET PRINTER INK

(75) Inventors: Bee Bee Ang, Singapore (SG); Tzy Woei Chu, Singapore (SG); Eng Kuan Lim, Singapore (SG); Pun Tian Ang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

(21) Appl. No.: 10/402,876

(22) Filed: Mar. 28, 2003

(65) Prior Publication Data

US 2004/0189745 A1 Sep. 30, 2004

(51) Int. Cl.[7] ..... B41J 2/165
(52) U.S. Cl. ..... 347/36; 347/31
(58) Field of Search ..... 347/35, 36

(56) References Cited

U.S. PATENT DOCUMENTS

| | | | |
|---|---|---|---|
| 4,683,481 | A | 7/1987 | Johnson |
| 5,278,584 | A | 1/1994 | Keefe |
| 6,132,026 | A | 10/2000 | Taylor |
| 6,213,583 | B1 | 4/2001 | Therien |

FOREIGN PATENT DOCUMENTS

| | | |
|---|---|---|
| JP | 04-060384 | * 10/1993 |

* cited by examiner

*Primary Examiner*—Shih-Wen Hsieh

(57) ABSTRACT

An inkjet waste ink handling system embodiment of the present invention includes a spittoon reservoir for collecting waste ink dropped from an inkjet printhead, and a ramp within the spittoon reservoir having an upper end that receives any ink dropped in and a lower end to which gravity conveys such ink. In this way, pillars of dried ink are prevented from accumulating.

5 Claims, 2 Drawing Sheets

SPITTOON SYSTEM FOR WASTE INKJET PRINTER INK

BACKGROUND

1. Field of the Invention

The present invention relates generally to inkjet printing mechanisms, and more particularly to a spittoon system for handling waste inkjet ink that has been discharged from an inkjet printhead during a nozzle clearing, purging or "spitting" routine.

2. Background of the Invention

Inkjet printing heads eject controlled sprays of ink onto a page while printing. Each such printhead has very small nozzles through which drops of various colored ink are fired. To print a typical image, the printhead is moved back and forth across a page, while ejecting patterns of ink drops. Conventional printheads use piezo-electric and thermal printhead technology. For instance, thermal ink ejection mechanisms are shown in U.S. Pat. No. 5,278,584 issued to Brian J. Keefe et al on Jan. 11, 1994 and U.S. Pat. No. 4,683,481, issued to Samuel A. Johnson on Jul. 28, 1987.

In thermal inkjet systems, barrier layers, ink channels and vaporization chambers are positioned between a nozzle orifice plate and a substrate layer. Such substrate layer typically includes linear arrays of heater elements, such as resistors, to heat ink inside the vaporization chambers. The instantaneous heating causes ink droplets to be ejected from the corresponding nozzle. By selectively energizing the resistors as the printhead moves across the page, the deposited ink can be precisely patterned to form particular text and graphic images.

A "service station" mechanism is typically included in each printer chassis for routine printhead maintenance. Such service stations usually include a capping system to seal the printhead nozzles from debris and to prevent drying of the ink inside the nozzles. Some caps are designed to help with ink priming, such as by being connected to a pumping unit that draws a vacuum on the printhead.

During operation, any clogs in the printhead can be periodically cleared by firing a number of drops of ink through each of the nozzles in a process known as "spitting." The waste ink is collected in a "spittoon" reservoir included in the service station.

Most service stations have a rubber wiper to wipe off excess ink, paper dust and other debris from the printhead surface. The wiping action can be done by moving the printhead across the wiper, the wiper across the printhead, or by moving both the printhead and the wiper.

Recent research has focused on improving the ink itself to improve the clarity and contrast of the printed image. Quicker, more waterfast printing with darker blacks and more vivid colors, pigment-based inks have been developed. Such pigment-based inks have a higher solid content than the earlier dye-based inks, and results in a higher optical density for the new inks. Both types of ink dry quickly. Such inkjet printing mechanisms produce high quality images on plain and specialty coated papers, transparencies, fabric, etc.

Unfortunately, the combination of small nozzles and quick-drying ink makes modern printheads more susceptible to clogging, e.g., from dried ink, minute dust particles, paper fibers, and solids within the new inks themselves.

Pillars of dried ink can grow up inside conventional ink spittoons to eventually contact the printhead. Such pillars resembling stalagmites can interfere with printhead movement, reduce print quality, and promote clogging of the inkjet printhead nozzles. Such stalagmites can grow to completely bridge across the narrow openings of some spittoons, and eventually close the spittoon opening. So prior art spittoons are made wide enough to prevent such bridging. But such extra width necessitates increasing the overall printer width.

A tapered screw spittoon system is disclosed in U.S. Pat. No. 6,213,583, issued to Patrick J Therien on Apr. 10, 2001. Such describes a tapered screw rotatably mounted in a reservoir of the spittoon. Ink residues are discharged onto a part of the tapered screw. When the screw is turned, ink residues are carried towards an exit in the reservoir wall, and squeezed out. This circumvents any ink residue stalagmite built-up and allows more efficient spittoon reservoir geometries.

Such complex mechanisms to deal with spittoon clogging add unnecessarily to the design, manufacturing, and expense of an inkjet printer. Less complex ways of dealing with the stalagmite build-up problem are needed to produce more affordable and more reliable printers.

SUMMARY OF THE INVENTION

Briefly, an inkjet waste ink handling system embodiment of the present invention includes a spittoon reservoir for collecting waste ink dropped from an inkjet printhead, and a ramp within the spittoon reservoir having an upper end that receives any ink dropped in and a lower end to which gravity conveys such ink. In this way, pillars of dried ink are prevented from accumulating.

According to a second embodiment of the present invention, a method for handling excess ink dropped from in inkjet printhead is provided. Firstly, excess ink is dropped from an inkjet printhead onto a top end of a ramp. Subsequently, the method uses gravity to flow said excess ink down to a bottom end of said ramp. In this way, pillars of dried ink are prevented from accumulating.

According to another embodiment of the present invention, an ink-jet printer includes an inkjet printhead that can discharge waste ink needing disposal, a spittoon reservoir located at a point under those that can be visited by the inkjet printhead and providing for collection of any waste ink dropped from the inkjet printhead, and a ramp within the spittoon reservoir having an upper end to receive any ink dropped in and a lower end to which gravity conveys such ink. The printer also includes a sponge disposed within the spittoon reservoir and adjacent to said lower end of the ramp and providing for collection of any ink that travels down the ramp. The sponge contacts the bottom end of the ramp and wicks in any ink traveling down toward it. The printer further includes an area disposed under the ramp for collecting and drying any ink not absorbed by the sponge and a capillary system disposed in the ramp and providing motivation for any ink on the ramp to move to the sponge. In such a printer, pillars of dried ink are prevented from accumulating.

Other aspects and advantages of the invention will become apparent from the following detailed description, taken in conjunction with the accompanying drawings, which description illustrates by way of example the principles of the invention.

DETAILED DESCRIPTION

Figure 1:
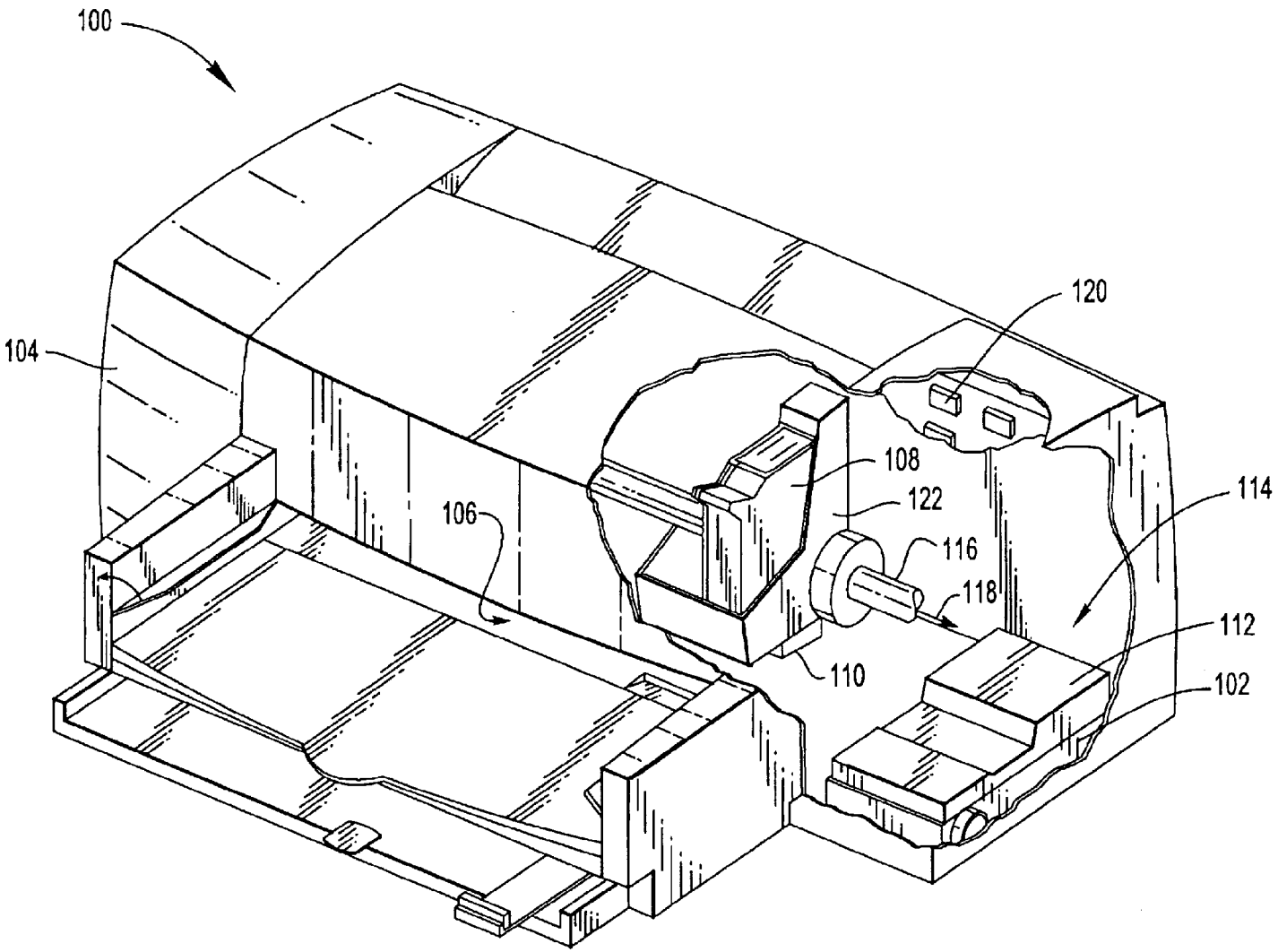
FIG. 1 is a perspective diagram of an inkjet printing mechanism embodiment of the present invention.

FIG. 1 illustrates an inkjet printer embodiment of the present invention, and is referred to herein by the general reference numeral 100. The printer 100 is representative of the many kinds of devices that use inkjets and spittoon reservoirs that can benefit from the present invention. For example, some inkjet-based fax and copier machines are included in alternative embodiments of the present invention.

The typical inkjet printer 100 includes a chassis 102 surrounded by a housing or casing enclosure 104. Sheets of paper are typically fed through a print zone 106 for printing as they pass by an inkjet and carriage assembly. Printer 100 includes an inkjet cartridge 108, a thermal printhead 110, a service station 112, a servicing region 114, a sliding carriage guide rod 116, a scanning axis 118, and a printer controller 120 that receives print-job instructions from a host computer. The sliding carriage guide rod 116 mounted with chassis 102 allows an inkjet carriage 122 to slide back and forth across the print zone 106. The scanning axis 118 is defined by the guide rod 116. Carriage positional feedback information can be provided to printer controller 120 by an optical encoder reader (not shown) mounted to carriage 122. Such typically reads an encoder strip that extends along the path of carriage travel.

The carriage 122 can be moved across guide rod 116 to a servicing region 114 inside casing 104. A service station 112 within servicing region 114 is used to keep the inkjet cartridge clean and disposes of excess ink that is wiped off. It caps the inkjet cartridge to prevent drying of the ink inside and to block contamination by loose debris.

When inside print zone 106, each paper sheet receives ink from ink-jet cartridge 108. The cartridge 108 is sometimes called a "pen" by artisans. The inkjet cartridge 108 includes an ink reservoir (not shown) for storing a supply of ink. The inkjet cartridge 108 has a printhead 110, with an orifice plate and a plurality of nozzles. The printhead 110 illustrated in FIG. 1 represents a thermal inkjet printhead, although other types of printheads may be used, such as piezoelectric printheads.

The outer surface of the orifice plate of the printhead 110 preferably lies in a common printhead plane. In the exemplary embodiment, such printhead plane extends substantially horizontally.

Here, only some of the pen servicing functions are discussed, e.g., spitting of the printhead 110. A spittoon system like that illustrated in U.S. Pat. No. 6,132,026, issued to Bret K. Taylor et al on Oct. 17, 2000, can be incorporated in the service station 112.

Figure 2A:
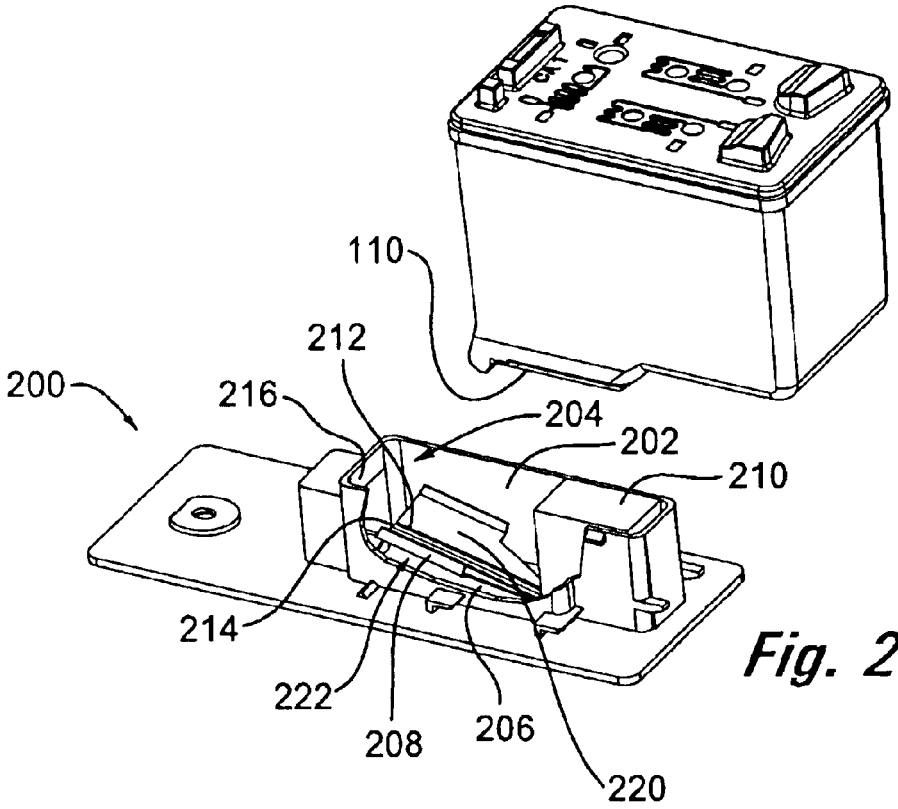
FIG. 2A is an exploded assembly diagram of a spittoon system useful in the printing mechanism of FIG. 1.
Figure 2B:
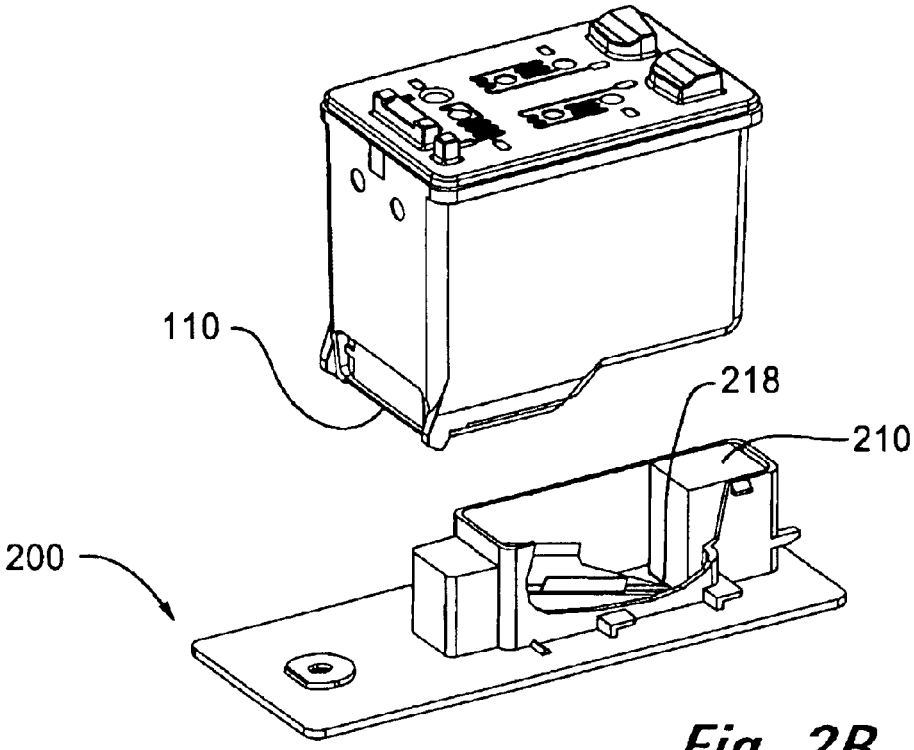
FIG. 2B is a diagram of an alternative perspective of the spittoon system of FIG. 2A.

FIGS. 2A and 2B show a printhead 110 and a spittoon system 200 which can be separated from the service station and mounted independently on the printer chassis.

The spittoon system 200 is supported by the chassis 102 in the service region 114 within the printer casing 104. The spittoon system 200 has a reservoir 202 for storing waste ink residues collected from the printhead 110 during servicing. The reservoir 202 has an opening 204 through which the ink residues from printhead 110 can drop inside. The reservoir 202 has vertical walls and a bottom 206 that parallels the plane in which the printhead 110 moves.

An inclined ramp 208 in the reservoir 202 extends down to an absorption foam 2100. A plurality of capillary drains 212 are included in the surface of the ramp 208 to promote drainage to the absorption foam 210. The ramp 208 has a first end 214 adjacent to a first side wall 216 of the reservoir 202 as well as the entranceway opening 204, and a second end 218 (FIG. 2B) adjacent to the absorption foam 210 as well as the bottom wall 206. The ramp 208 has a discharged region 220 close to the first end 214 for receiving ink residues (not shown) entering into the reservoir 202 from the printhead 110. A space 222 is provided between the underside of ramp 208 and the bottom of reservoir 202.

During spitting, the ink residues drop into the reservoir 202 and land on the ramp 208. Gravity flows the ink residues down the ramp 208 toward the absorption foam 210. The capillary drains 212 create a capillary action, which assists the flow of the ink residues to the absorption foam 210. The ramp 208 preferably has a smooth surface, to promote ink drainage. The absorption foam 210 can be Polyester absorbent felt. The absorption of the inks that have reached the absorption foam 210 helps draw even more ink down the ramp 208.

Eventually the absorption foam 210 will saturate. When this happens, ink flowing down the ramp 208 will spill over the bottom edges of the ramp and is collect underneath. Such ink will dry and make for more room underneath the ramp. So it helps if the ramp 208 is made of very thin sheet material. In alternative embodiments of the present invention, the ramp 208 can be flat bottomed or round channeled.

Embodiments of the present invention, in general, run excess ink down a ramp in a spittoon reservoir to a sponge. When the sponge fills, further excess ink is allowed to run down and collect under to ramp to dry. Such prevents the growth of dried ink pillars that can interfere with inkjet operation and clear, clean printing.

What is claimed is:

1. An inkjet waste ink handling system, comprising:

a spittoon reservoir for collecting waste ink dropped from an ink-jet printhead;

a ramp within the spittoon reservoir having an upper end that receives any ink dropped in and a lower end to which gravity conveys such ink;

a sponge disposed within the spittoon reservoir and adjacent to said lower end of the ramp and providing for collection of any ink that travels down the ramp; and an area disposed under the ramp for collecting and drying any ink not absorbed by the sponge, wherein, pillars of dried ink are prevented from accumulating.

2. The system of claim 1, wherein:

the sponge contacts said bottom end of the ramp and wicks in any ink traveling down toward it.

3. The system of claim 1, further comprising:

a capillary system disposed in the ramp and providing motivation for any ink on the ramp to move to the lower end.

4. A method for handling excess ink dropped from an inkjet printhead, the method comprising:

dropping excess ink from an inkjet printhead onto a top end of a ramp;

using gravity to flow said excess ink down to a bottom end of said ramp;

wicking in said excess ink with a sponge in contact with said ramp; and collecting any ink not absorbed by said sponge under said ramp for eventual drying, wherein, pillars of dried ink are prevented from accumulating.

5. An inkjet printer, comprising:

an inkjet printhead that can discharge waste ink needing disposal;

a spittoon reservoir located at a point that can be visited by the inkjet printhead and providing for collection of any waste ink dropped from the inkjet printhead;

a ramp within the spittoon reservoir having an upper end to receive any ink dropped in and a lower end to which gravity conveys such ink;

a sponge disposed within the spittoon reservoir and adjacent to said lower end of the ramp and providing for collection of any ink that travels down the ramp, wherein the sponge contacts said bottom end of the ramp and wicks in any ink traveling down toward it;

an area disposed under the ramp for collecting and drying any ink not absorbed by the sponge; and a capillary system disposed in the ramp and providing motivation for any ink on the ramp to move to the sponge;

wherein, pillars of dried ink are prevented from accumulating.

* * * * *